US010167433B2

(12) United States Patent
Zimmerman

(10) Patent No.: US 10,167,433 B2
(45) Date of Patent: Jan. 1, 2019

(54) PROCESS FOR PRODUCING DIESEL FROM A HYDROCARBON STREAM

(71) Applicant: UOP LLC, Des Plaines, IL (US)

(72) Inventor: Paul R. Zimmerman, Palatine, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/423,962

(22) Filed: Feb. 3, 2017

(65) Prior Publication Data

US 2017/0226434 A1 Aug. 10, 2017

Related U.S. Application Data

(60) Provisional application No. 62/291,764, filed on Feb. 5, 2016.

(51) Int. Cl.
*C10G 67/02* (2006.01)

(52) U.S. Cl.
CPC ..... *C10G 67/02* (2013.01); *C10G 2300/202* (2013.01); *C10G 2400/04* (2013.01)

(58) Field of Classification Search
CPC ..... C10G 67/02; C10G 2300/202; C10G 2400/04
See application file for complete search history.

(56) References Cited

U.S. PATENT DOCUMENTS

| | | | | |
|---|---|---|---|---|
| 3,130,006 | A | 4/1964 | Rabo et al. | |
| 5,787,025 | A | 7/1998 | Muwafi et al. | |
| 8,394,255 | B2 | 3/2013 | McCarthy et al. | |
| 8,753,501 | B2 | 6/2014 | Zimmerman et al. | |
| 8,936,714 | B2 | 1/2015 | Kokayeff et al. | |
| 8,936,716 | B2 | 1/2015 | Hoehn et al. | |
| 8,940,254 | B2 | 1/2015 | Hoehn et al. | |
| 8,999,144 | B2 | 4/2015 | Wieber | |
| 8,999,150 | B2 | 4/2015 | Hoehn et al. | |
| 8,999,256 | B2 | 4/2015 | Zimmerman et al. | |
| 2014/0144809 | A1* | 5/2014 | Kokayeff ..... | C10G 67/02 208/57 |
| 2015/0060330 | A1 | 3/2015 | Sadler et al. | |

FOREIGN PATENT DOCUMENTS

| | | | |
|---|---|---|---|
| CA | 2525650 | C | 7/2013 |
| EP | 1752511 | B1 | 3/2009 |
| WO | 2016003572 | A1 | 1/2016 |
| WO | 2016003572 | A1 | 7/2016 |

OTHER PUBLICATIONS

PCT Search Report dated May 4, 2017 for International Application No. PCT/US2017/016368.
Search Report dated May 4, 2017 for corresponding PCT Appl. No. PCT/US2017/016368.

* cited by examiner

*Primary Examiner* — Randy Boyer
*Assistant Examiner* — Juan C Valencia

(57) ABSTRACT

A process and apparatus are disclosed for hydrocracking a hydrocarbon feed in a hydrocracking unit and hydrotreating a vaporous hydrocracked stream. The hydrotreated effluent stream can be separated and stripped to produce a ULSD stream fit for storage without further processing. The hydrocracked liquid stream can be stripped and fractionated to produce a diesel stream that can be transported to the hydrotreating unit.

18 Claims, 1 Drawing Sheet

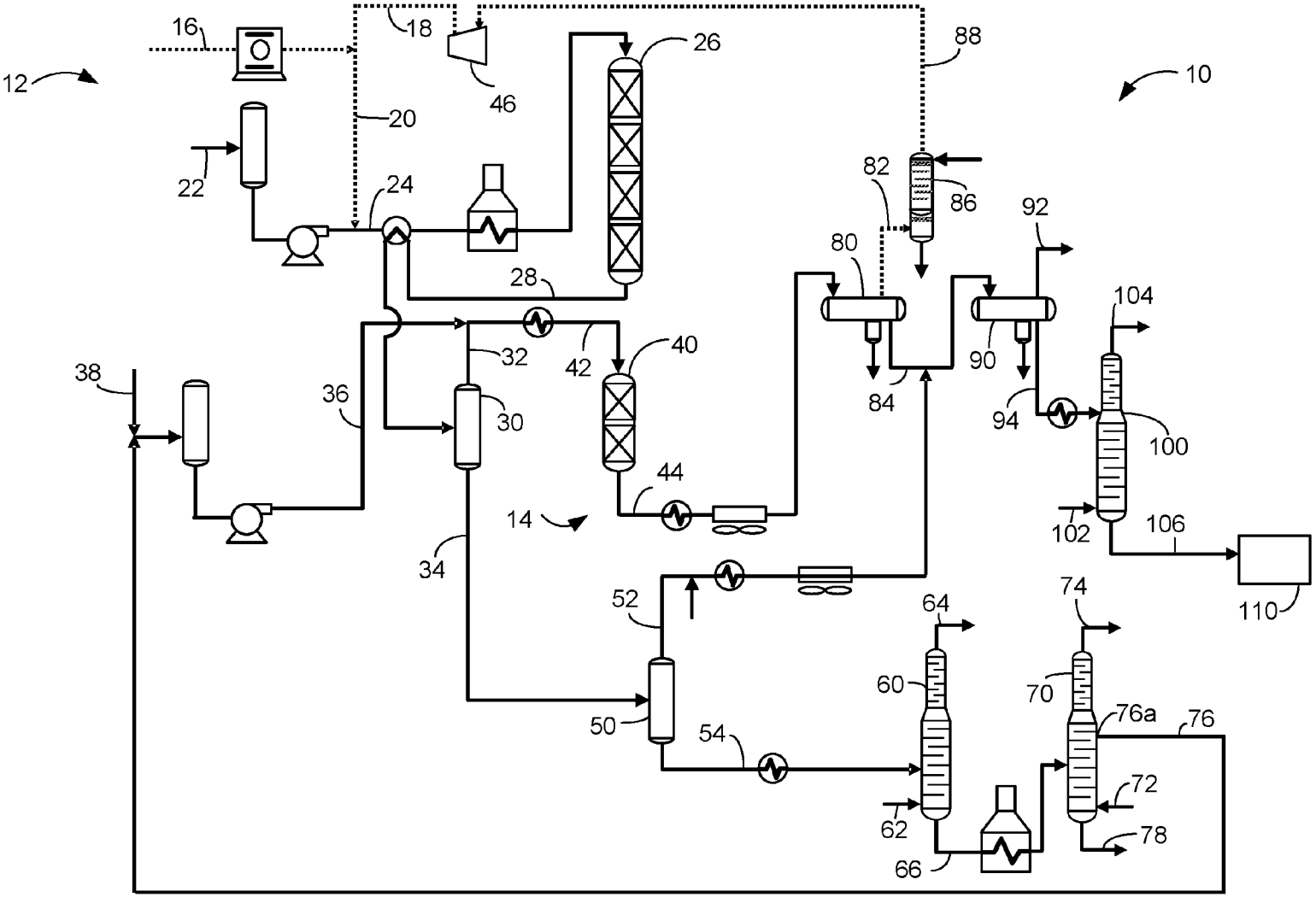
10
12
14
16
18
20
22
24
26
28
30
32
34
36
38
40
42
44
46
50
52
54
60
62
64
66
70
72
74
76
76a
78
80
82
84
86
88
90
92
94
100
102
104
106
110

PROCESS FOR PRODUCING DIESEL FROM A HYDROCARBON STREAM

CROSS-REFERENCE TO RELATED APPLICATION

This application claims priority from Provisional Application No. 62/291,764 filed Feb. 5, 2016, the contents of which are hereby incorporated by reference.

FIELD OF THE INVENTION

The field of the invention is the production of diesel by hydrotreating and hydrocracking.

BACKGROUND OF THE INVENTION

Hydrocracking refers to a process in which hydrocarbons crack in the presence of hydrogen and catalyst to lower molecular weight hydrocarbons. Depending on the desired output, the hydrocracking unit may contain one or more beds of the same or different catalyst. Hydrocracking is a process used to crack hydrocarbon feeds such as vacuum gas oil (VGO) to diesel including kerosene and gasoline motor fuels.

Mild hydrocracking (MHC) is generally used upstream of a fluid catalytic cracking (FCC) or other process unit to improve the quality of an unconverted oil that can be fed to the downstream conversion unit, while converting part of the feed to lighter products such as diesel. As world demand for diesel motor fuel is growing relative to gasoline motor fuel, mild hydrocracking is being considered for biasing the product slate in favor of diesel at the expense of gasoline. Mild hydrocracking may be operated with less severity than partial or full conversion hydrocracking to balance production of diesel with the FCC unit, which primarily is used to make naphtha. Partial or full conversion hydrocracking is used to produce diesel with less yield of the unconverted oil which can be fed to a downstream conversion unit.

Due to environmental concerns and newly enacted rules and regulations, saleable diesel must meet lower and lower limits on contaminates, such as sulfur and nitrogen. New regulations require essentially complete removal of sulfur from diesel. For example, the ultra low sulfur diesel (ULSD) requirement is typically less than 10 wppm sulfur.

Hydrotreating refers to a process in which olefins and aromatics are saturated and heteroatoms, such as sulfur, nitrogen and metals are removed from the hydrocarbon feedstock over catalyst in the presence of hydrogen. Hydrotreating is an essential step in the production of ULSD.

Hydroprocessed streams are typically stripped with an inert gas such as steam to remove volatile ammonia and hydrogen sulfide to reduce sulfur and nitrogen concentration in the product fuel stream. Stripped hydroprocessed streams are then fractionated to provide product fuel streams.

MHC reactors are typically operated at low to moderate conversion and lower pressures than higher conversion hydrocrackers, so the distillate produced from MHC units can be high in sulfur, such as 20 to 150 wppm sulfur, because the environment in the MHC reactor has a high concentration of hydrogen sulfide. In addition, the high concentration of ammonia in the MHC reactor reduces hydrocracking activity requiring higher operating temperatures further limiting organosulfur conversion. As a result, diesel from the MHC reactor must be also treated in a hydrotreating unit to achieve ULSD.

There is a continuing need for improved methods of producing more diesel from hydrocarbon feedstocks than gasoline. Such methods must ensure that the diesel product meets increasingly stringent product requirements.

BRIEF SUMMARY OF THE INVENTION

A hydrotreating unit is located to hydrotreat hydrocracked vapor at the overhead of a hydrocracking separator. The hydrotreated stream is kept separate from the unhydrotreated hydrocracked liquid by routing the hydrotreated liquid to a dedicated hydrotreating stripper which produces ULSD in the stripped hydrotreated liquid without need for further fractionation. The hydrocracked liquid may be stripped and fractionated to produce a diesel stream that may be hydrotreated to produce ULSD.

BRIEF DESCRIPTION OF THE DRAWING

The FIGURE is a simplified process flow diagram of an embodiment of the present invention.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "bypass" means that the object is out of downstream communication with a bypassing subject at least to the extent of bypassing.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. Unless otherwise indicated, the top pressure is the pressure of the overhead vapor at the vapor outlet of the column, and the bottom temperature is the liquid bottom outlet temperature. Unless otherwise indicated, overhead lines and bottoms lines refer to the net lines from the column downstream of any reflux or reboil to the column. Stripping columns may omit a reboiler at a bottom of the column and instead provide heating requirements and separation impetus from a fluidized inert media such as steam.

As used herein, boiling points refer to the True Boiling Point. The term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which the sample begins to boil using ASTM D-86.

As used herein, the term "end point" (EP) means the temperature at which the sample has all boiled off using ASTM D-86.

As used herein, the term "diesel conversion" means conversion of feed to material that boils at or below the diesel boiling range. The cut point of the diesel boiling range is between 343° and 399° C. (650° to 750° F.) using the True Boiling Point distillation method.

As used herein, the term "diesel boiling range" means hydrocarbons having IBP no less than about 132° F. (269° C.) and the cut point of the diesel boiling range using the True Boiling Point distillation method.

As used herein, the term "T5" or "T95" means the temperature at which 5 volume percent or 95 volume percent, as the case may be, respectively, of the sample boils using ASTM D-86.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

DETAILED DESCRIPTION

The apparatus and process 10 for producing diesel comprise a hydrocracking unit 12, and a hydrotreating unit 14. A first hydrocarbon feed is fed to the hydrocracking unit 12 to crack hydrocarbons down into the diesel range. The hydrocracked effluent stream is separated and a resulting vaporous hydrocracked stream is hydrotreated and stripped to produce ULSD.

A make-up hydrogen stream in a make-up hydrogen line 16 is compressed and joined to a compressed recycle hydrogen stream comprising hydrogen in a recycle line 18 to provide a process hydrogen stream in a process hydrogen line 20.

A first hydrocarbon feed stream in a hydrocarbon feed line 22 may be pumped from a surge drum and joined with the process hydrogen stream in the process hydrogen line 20 to provide a hydroprocessing feed stream in a hydroprocessing feed line 24.

In one aspect, the process and apparatus described herein are particularly useful for hydroprocessing a hydrocarbon feedstock. Illustrative hydrocarbon feedstocks include hydrocarbonaceous streams having components boiling above about 288° C. (550° F.), such as atmospheric gas oils, VGO, deasphalted, vacuum, and atmospheric residua, coker distillates, straight run distillates, solvent-deasphalted oils, pyrolysis-derived oils, high boiling synthetic oils, cycle oils, hydrocracked feeds, cat cracker distillates and the like. A suitable hydrocarbonaceous feedstock is a VGO or other hydrocarbon fraction having at least 50 percent by weight, and usually at least 75 percent by weight, of its components boiling at a temperature above about 399° C. (750° F.). A typical VGO normally has a boiling point range between about 315° C. (600° F.) and about 565° C. (1050° F.).

A hydrocracking reactor 26 is in downstream communication with the make-up hydrogen line 16 and the hydrocarbon feed line 24. The hydroprocessing stream in the hydroprocessing feed line 24 may be heat exchanged with a hydrocracked effluent stream in line 28 and further heated in a fired heater before entering the hydrocracking reactor 26.

Hydrocracking refers to a process in which hydrocarbons crack in the presence of hydrogen to lower molecular weight hydrocarbons. In the hydrocracking reactor 26, desired conversion of heavier hydrocarbons to diesel range hydrocarbons is obtained along with conversion of organic sulfur and nitrogen in the hydrocarbon feed stream.

The hydrocracking reactor 26 may comprise one or more vessels, multiple beds of catalyst in each vessel, and various combinations of hydrotreating catalyst and hydrocracking catalyst in one or more vessels. In some aspects, the hydrocracking reaction provides total conversion of at least 20 vol % and typically greater than 60 vol % of the hydrocarbon feed to products boiling below the diesel cut point. The hydrocracking reactor 26 may operate at partial conversion of more than 50 vol % or full conversion of at least 90 vol % of the feed based on total conversion. The first vessel or bed may include hydrotreating catalyst for the purpose of demetallizing, desulfurizing or denitrogenating the hydrocarbon feed stream. Hydrogen from the recycle hydrogen stream 18 may also be fed to the hydrocracking reactor 26 between catalyst beds (not shown).

The hydrocracking reactor 26 may be operated at mild hydrocracking conditions. Mild hydrocracking conditions will provide about 20 to about 60 vol %, preferably about 20 to about 50 vol %, total conversion of the hydrocarbon feed to product boiling below the diesel cut point. In mild hydrocracking, converted products are biased in favor of diesel. In a mild hydrocracking operation, the hydrotreating catalyst has just as much or a greater conversion role than hydrocracking catalyst. Conversion across the hydrotreating catalyst may be a significant portion of the overall conversion. If the hydrocracking reactor 26 is intended for mild hydrocracking, it is contemplated that the hydrocracking reactor 26 may be loaded with all hydrotreating catalyst, all hydrocracking catalyst, or some beds of hydrotreating catalyst and some beds of hydrocracking catalyst. In the last case, the beds of hydrocracking catalyst may typically follow beds of hydrotreating catalyst.

The hydrocracking reactor 26 in the FIGURE has four catalyst beds in one reactor vessel. If mild hydrocracking is desired, it is contemplated that the first catalyst bed comprise hydrotreating catalyst or hydrocracking catalyst and the last catalyst bed comprise hydrocracking catalyst. If partial or full hydrocracking is preferred, more beds of hydrocracking catalyst may be used than used in mild hydrocracking.

At mild hydrocracking conditions, the hydrocarbon feed is selectively converted to heavy products such as diesel and kerosene with a lower yield of lighter hydrocarbons such as naphtha and gas. Pressure is also moderate to limit the hydrogenation of the bottoms product to an optimal level for downstream processing.

In one aspect, for example, when a balance of middle distillate and gasoline is preferred in the converted product, mild hydrocracking may be performed in the hydrocracking reactor 26 with hydrocracking catalysts that utilize amorphous silica-alumina bases or low-level zeolite bases combined with one or more Group VIII or Group VIB metal hydrogenating components. In another aspect, when middle distillate is significantly preferred in the converted product over gasoline production, partial or full hydrocracking may be performed in the hydrocracking reactor 26 with a catalyst which comprises, in general, any crystalline zeolite cracking base upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between 4 and 14 Angstroms ($10^{-10}$ meters). It is preferred to employ zeolites having a relatively high silica/alumina mole ratio between 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between 8-12 Angstroms ($10^{-10}$ meters), wherein the silica/alumina mole ratio is 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least 10 percent, and preferably at least 20 percent, metal-cation-deficient, based on the initial ion-exchange capacity. In another aspect, a desirable and stable class of zeolites is one wherein at least 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between 0.05 percent and 30 percent by weight may be used. In the case of the noble metals, it is normally preferred to use 0.05 to 2 wt %.

The method for incorporating the hydrogenating metal is to contact the base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371° C. (700° F.) to 648° C. (1200° F.) in order to activate the catalyst and decompose ammonium ions. Alternatively, the base component may first be pelleted, followed by the addition of the hydrogenating component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between 5 and 90 wt %. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

By one approach, the hydrocracking conditions may include a temperature from about 290° C. (550° F.) to about 468° C. (875° F.), preferably about 343° C. (650° F.) to about 435° C. (815° F.), a pressure from about 3.5 MPa (500 psig) to about 20.7 MPa (3000 psig), a liquid hourly space velocity (LHSV) from about 1.0 to less than about 2.5 $hr^{-1}$ and a hydrogen rate of about 421 $Nm^3/m^3$ oil (2,500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 5.5 MPa (gauge) (800 psig) to about 13.8 MPa (gauge) (2000 psig) or more typically about 6.9 MPa (gauge) (1000 psig) to about 11.0 MPa (gauge) (1600 psig), a liquid hourly space velocity (LHSV) from about 0.5 $hr^{-1}$ to about 2 $hr^{-1}$ and preferably about 0.7 $hr^{-1}$ to about 1.5 $hr^{-1}$ and a hydrogen rate of about 421 $Nm^3/m^3$ (2,500 scf/bbl) oil to about 1,685 $Nm^3/m^3$ (10,000 scf/bbl) oil.

The hydrocracking effluent stream in line 28 may be heat exchanged with the hydrocarbon feed stream in line 24. The hydrocracking effluent stream in line 28 may be separated in a hydrocracking separator 30 in downstream communication with the hydrocracking reactor 26 to provide a vaporous hydrocracked stream comprising hydrogen in a hydrocracking separator overhead line 32 and a liquid hydrocracked stream in a hydrocracking separator bottoms line 34. The vaporous hydrocracked stream comprising hydrogen may be mixed with a diesel stream in line 36 perhaps prior to cooling and enter into a hydrotreating reactor 40 together. Accordingly, the hydrotreating reactor 40 may be in downstream communication with the hydrocracking separator 30 and the hydrocracking reactor 26.

The hydrocracking separator 30 may be operated at a temperature selected to control the endpoint or the T95 specification of the diesel stream. For example, to obtain a T95 between 525 and 670° C., the hydrocracking separator 96 may be operated at a temperature between about 260° C. (500° F.) and about 316° C. (600° F.). The pressure of the hydrocracking separator 30 is just below the pressure of the hydrocracking reactor 26 accounting for pressure drop in the intervening lines and equipment. All of the lighter hydrocarbons and gases go up in the vaporous hydrocracked stream in line 32. Accordingly, all of the hydrocarbons heavier than diesel exit the hydrocracking separator in the hydrocracking bottoms line 34 as a liquid hydrocracked stream.

The liquid hydrocracked stream 34 may be flashed in a hydrocracking flash drum 50 to provide a flash vaporous hydrocracked stream in a flash hydrocracking overhead line 52 and a flash liquid hydrocracked stream in a flash hydrocracked bottoms line 54. An aqueous stream may be added to the flash vaporous hydrocracked stream in flash hydrocracking overhead line 52 to wash out sulfides. The flash vaporous hydrocracked stream may be cooled and added to a separated liquid hydrotreated stream in a hydrotreating separator bottoms line 84 and be flashed therewith. The hydrocracking flash drum 50 may be operated at the same temperature as the hydrocracking separator 40 but at a lower pressure of between 1.4 MPa (200 psig) and 3.1 MPa (gauge) (450 psig). The flash liquid hydrocracked stream in bottoms line 54 may be fractionated in a fractionation column 70.

The flash liquid hydrocracked stream may first be stripped in a hydrocracking stripping column 60 before it is fractionated in the fractionation column 70 to remove more of the light gases from the liquid hydrocracked effluent. The hydrocracked flash liquid stream in the hydrocracking flash bottoms line 54 may be heated and fed to the hydrocracking stripping column 60. The flash liquid hydrocracked stream may be stripped with steam from line 62 to provide a hydrocracked light ends stream of hydrogen, hydrogen sulfide, ammonia, steam and other gases in a hydrocracking stripper overhead line 64. The light ends stream may be condensed and a portion of the condensed stream may be refluxed to the hydrocracking stripper column 60. The hydrocracking stripping column 60 may be operated with a bottoms temperature between about 232° C. (450° F.) and about 288° C. (550° F.) and an overhead pressure of about 690 kPa (100 psig) to about 1034 kPa (gauge) (150 psig). A stripped hydrocracked stream in a hydrocracking stripper bottoms line 66 may be removed from a bottom of the hydrocracking stripping column 60, heated in a fired heater and fed to the fractionation column 70.

The fractionation column 70 may fractionate the stripped hydrocracked stream by stripping it with steam from line 72 to provide an overhead product stream in line 74. The overhead product stream in line 74 may comprise a naphtha stream that may require further processing before blending in a gasoline pool. The naphtha stream may first require catalytic reforming to improve the octane number. The reforming catalyst may not require the overhead product stream to be further desulfurized in a naphtha hydrotreating unit prior to reforming. The hydrocracking fractionation column 70 fractionates the stripped liquid hydrocracking effluent to provide a hydrocracked diesel stream comprising diesel having an initial boiling point of about 121° C. (250° F.), preferably about 177° C. (350° F.), to about 288° C. (550° F.) in a diesel line 76 and substantially reduced in sulfur and nitrogen concentration.

The diesel stream in line 76 may be taken as a side cut stream from a side outlet 76*a* of the fractionation column 70. It is also contemplated that a further side cut be taken to provide a separate light diesel or kerosene stream taken above the outlet 76*a*. A hydrocracked heavy stream comprising unconverted gas oil may be removed in a fractionator bottoms line 78. The hydrocracked heavy stream may be transported to a downstream conversion unit such as an FCC unit. A portion of the overhead stream in line 74 may be condensed and refluxed to the fractionation column 70. The hydrocracking fractionation column 70 may be operated with a bottoms temperature between about 288° C. (550° F.) and about 385° C. (725° F.), preferably between about 315° C. (600° F.) and about 357° C. (675° F.) and at or near atmospheric pressure. A portion of the hydrocracked heavy stream may be reboiled and returned to the fractionation column 70 to add heat to the fractionation column instead of using steam stripping.

The hydrocracked diesel stream in diesel line 76 may not meet ULSD specification particularly if the hydrocracking reactor 26 operates under mild hydrocracking conditions. Accordingly, the hydrocracked diesel stream in line 76 may be transported to the hydrotreating reactor 40 to complete the necessary desulfurization and denitrogenation of the hydrocracked diesel stream. In an embodiment, the hydrocracked diesel stream may be fed to a surge drum and pumped via line 36 to the hydrotreating reactor 40. In an aspect, the hydrocracked diesel stream may be recycled to the vaporous hydrocracked stream in the hydrocracking separator overhead line 32, heated and fed to the hydrotreating reactor 40. In a further aspect, an additional diesel co-feed stream in line 38 may also be fed to the hydrotreating reactor 40. In one embodiment, the diesel co-feed stream may be added to the hydrocracked diesel stream in diesel line 76 and they together supply a surge drum before being pumped in line 36 to the hydrotreating reactor 40. In sum, the hydrocracked diesel stream from line 76, the vaporous hydrocracked stream from hydrocracking separator overhead line 32 and, perhaps, the diesel co-feed stream from line 38 are all fed to the hydrotreating reactor 40 with another stream(s) or separately. Suitable co-feeds in co-feed line 38 may include diesel streams such as coker distillates, straight run distillates, cycle oils and cat cracker distillates boiling in the diesel boiling range. These hydrocarbonaceous feed stocks may contain from 0.1 to 4 wt % sulfur.

A hydrotreating feed stream which may comprise the vaporous hydrocracked stream from the hydrocracking separator overhead line 32 and perhaps one or both of the hydrocracked diesel stream from diesel line 76 and the diesel co-feed stream from co-feed line 38 may be heated in a hydrotreating feed line 42 and fed to the hydrotreating reactor 40 in a hydrotreating feed line 42. Consequently, the hydrotreating reactor 40 may be in downstream communication with the hydrocracking separator 30, the hydrocracking reactor 26 and the fractionation column 70, specifically the side outlet 76*a* thereof. In the hydrotreating reactor 40, the hydrotreating feed stream in the hydrotreating feed line 42 comprising the vaporous hydrocracked stream from the hydrocracking separator overhead line 32 and perhaps one or both of the hydrocracked diesel stream from line diesel line 76 and the diesel co-feed stream from co-feed line 38 is hydrotreated in the presence of hydrogen in the vaporous hydrocracked stream and hydrotreating catalyst to provide a hydrotreated effluent stream in hydrotreating effluent line 44. In an aspect, all of the hydrogen used in the hydrotreating reactor 40 is provided from the vaporous hydrocracked stream in hydrocracking separator overhead line 32. In another aspect, the hydrotreating reactor 40 is operated with the hydrogen and the hydrocarbon in the vaporous hydrocracked stream and perhaps one or both of the hydrocracked diesel stream and the diesel co-feed stream flowing downwardly in the hydrotreating reactor 40.

Hydrotreating is a process wherein hydrogen gas is contacted with hydrocarbon in the presence of suitable catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Some hydrotreating processes are specifically designed to saturate aromatics. Cloud point of the hydrotreated product may also be reduced.

The hydrotreating reactor 40 may comprise more than one vessel and multiple beds of catalyst. The hydrotreating reactor 40 in the FIGURE has two beds in one reactor vessel, but more or less beds may be suitable. Two to four beds of catalyst in the hydrotreating reactor 40 is preferred. In the hydrotreating reactor, hydrocarbons with heteroatoms are further demetallized, desulfurized and denitrogenated. The hydrotreating reactor may also contain hydrotreating catalyst that is suited for saturating aromatics, hydrodewaxing and hydroisomerization. It is contemplated that one of the beds in the hydrotreating reactor 40 may be a hydrocracking catalyst to open naphthenic rings produced from aromatics saturated in an upstream catalyst bed. Hydrotreating catalyst suited for one or more of the aforementioned desired reactions may be loaded into each of the beds in the hydrotreating reactor. It is contemplated that a separate hydrogen stream may also be fed to the hydrotreating reactor 40 between catalyst beds (not shown).

Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same hydrotreating reactor 36. The Group VIII metal is typically present in an amount ranging from 2 to 20 wt %, preferably from 4 to 12 wt %. The Group VI metal will typically be present in an amount ranging from 1 to 25 wt %, preferably from 2 to 25 wt %.

Preferred hydrotreating reaction conditions include a temperature from 290° C. (550° F.) to 455° C. (850° F.), suitably 316° C. (600° F.) to 427° C. (800° F.) and preferably 343° C. (650° F.) to 399° C. (750° F.), a pressure from 4.1 MPa (600 psig), preferably 6.2 MPa (900 psig) to 13.1 MPa (1900 psig), a liquid hourly space velocity of the fresh hydrocarbonaceous feedstock from 0.5 $hr^{-1}$ to 4 $hr^{-1}$, preferably from 1.5 to 3.5 $hr^{-1}$, and a hydrogen rate of 168 to 1,011 $Nm^3/m^3$ oil (1,000-6,000 scf/bbl), preferably 168 to 674 $Nm^3/m^3$ oil (1,000-4,000 scf/bbl) for diesel feed, with a hydrotreating catalyst or a combination of hydrotreating catalysts. The hydrotreating unit 12 may be integrated with the hydrocracking unit 14, so they both operate at the same pressure accounting for normal pressure drop over intervening equipment.

The hydrocarbon hydrotreating feed stream that is passed through the hydrotreating reactor 40 is reduced in nitrogen to levels favorable for hydrocracking and also converts a significant amount of organic sulfur. A hydrotreated effluent stream exits the hydrotreating reactor 40 in the hydrotreated effluent line 44.

The hydrotreating effluent stream in line 44 may be cooled and separated into a vaporous hydrotreated stream and a liquid hydrotreated stream. The liquid hydrotreated effluent stream may be stripped in a hydrotreating stripping column 100 to provide a product stream comprising ULSD. The hydrotreated stream is kept separate from the unhydrotreated hydrocracked liquid by routing the hydrotreated liquid to a dedicated hydrotreating stripping column 100 that is distinct from the hydrocracking stripper column 60. The separation of the hydrotreated effluent stream in line 44 may comprise separating the hydrotreated effluent stream in a hydrotreating separator 80 into a separated vaporous hydrotreated stream in a hydrotreating separator overhead line 82 and a separated liquid hydrotreated stream in a hydrotreating separator bottoms line 84. The hydrotreating separator 80 may be operated at a temperature of about 30° C. (86° F.) to about 80° C. (176° F.) and about the same pressure as the hydrotreating reactor 40 accounting for pressure drop in the lines and equipment between the two vessels.

The separated vaporous hydrotreated stream in the hydrotreating separator overhead line 82 may be scrubbed with an aqueous absorbent solution which may comprise an amine in a scrubber column 86 to absorb ammonia and hydrogen sulfide from the vaporous hydrotreated stream as is conventional prior to recycle of a purified hydrogen recycle stream in a scrubber overhead line 88 to a recycle gas compressor 46.

The separated liquid hydrotreated stream in hydrotreating separated bottoms line 84 may be flashed in a hydrotreating flash drum 90 to provide a flash vaporous hydrotreated stream comprising light ends in a flash hydrotreating overhead line 92 and a flash liquid hydrotreated stream in a flash hydrotreating bottoms line 94. In an aspect, the flash vaporous hydrocracked stream in the flash hydrocracking overhead line 52 may be mixed with the separated liquid hydrotreated stream in the hydrotreating separator bottoms line 84 and flashed together in the hydrotreating flash drum 90. The hydrotreating flash drum 90 may be operated at the same temperature as the hydrotreating separator 80 but at a lower pressure of between about 1.4 MPa (gauge) (200 psig) and 3.1 MPa (gauge) (450 psig).

The flash liquid hydrotreated stream in the flash hydrotreating bottoms line 94 comprising a liquid hydrotreated stream and a portion of the hydrocracked effluent stream may be heated and fed to a hydrotreating stripper column 100 in downstream communication with the hydrocracking separator 30, the hydrocracking flash drum 50, the hydrotreating reactor 40, the hydrotreating separator 80 and the hydrotreating flash drum 90. The flash liquid hydrotreated stream in the hydrotreating flash bottoms line 94 may be heated and stripped in the hydrotreating stripper column 100 with steam from steam line 102 to provide a light ends stream of hydrogen, hydrogen sulfide, ammonia, steam and other gases in a hydrotreating stripper overhead line 104. The light ends stream may be condensed and a portion of the condensed stream may be refluxed to the hydrotreating stripper column 100 in a hydrotreating stripper overhead line 104. The hydrotreating stripping column 100 may be operated with a bottoms temperature between about 232° C. (450° F.) and about 288° C. (550° F.) and an overhead pressure of about 690 kPa (gauge) (100 psig) to about 1034 kPa (gauge) (150 psig). A stripped hydrotreated stream comprising ULSD having an initial boiling point of about 121° C. (250° F.), preferably about 177° C. (350° F.), to about 288° C. (550° F.) may be removed from a bottom of the hydrotreating stripping column 100 in hydrotreating stripper bottoms line 106 as product. The stripped hydrotreated stream can be sent to storage in the diesel pool 110 for ULSD without further fractionation, treating or refining.

It is contemplated that the hydrotreating stripper 100 may be stacked on the hydrocracking stripper 60 or provided in the same vessel with a dividing wall isolating the bottoms of the two stripper sections with the two stripper sections sharing a common overhead condenser and receiver.

Specific Embodiments

While the following is described in conjunction with specific embodiments, it will be understood that this description is intended to illustrate and not limit the scope of the preceding description and the appended claims.

A first embodiment of the invention is a process for producing diesel from a hydrocarbon stream comprising hydrocracking a hydrocarbon feed stream over hydrocracking catalyst in the presence of hydrogen to provide a hydrocracked effluent stream; separating the hydrocracked effluent stream into a vaporous hydrocracked stream and a liquid hydrocracked stream; hydrotreating the vaporous hydrocracked stream over hydrotreating catalyst in the presence of hydrogen to provide a hydrotreated effluent stream; separating the hydrotreated effluent stream into a vaporous hydrotreated stream and a liquid hydrotreated stream; and stripping the liquid hydrotreated stream to provide a product stream comprising ultra low sulfur diesel. An embodiment of the invention is one, any or all of prior embodiments in this paragraph up through the first embodiment in this paragraph wherein separating the hydrotreated effluent stream comprises separating the hydrotreated effluent stream into a separated vaporous hydrotreated stream and a separated liquid hydrotreated stream and flashing the separated liquid hydrotreated stream to provide a flash vaporous hydrotreated stream and a flash liquid hydrotreated stream comprising the liquid hydrotreated stream. An embodiment of the invention is one, any or all of prior embodiments in this paragraph up through the first embodiment in this paragraph further comprising flashing the liquid hydrocracked stream to provide a flash vaporous hydrocracked stream and a flash liquid hydrocracked stream; stripping the flash liquid hydrocracked stream to provide a stripped hydrocracked stream; fractionating the stripped hydrocracked stream to provide a hydrocracked diesel stream; and hydrotreating the hydrocracked diesel stream. An embodiment of the invention is one, any or all of prior embodiments in this paragraph up through the first embodiment in this paragraph wherein the hydrocracked diesel stream is hydrotreated with the vaporous hydrocracked stream in the hydrotreating step. An embodiment of the invention is one, any or all of prior embodiments in this paragraph up through the first embodiment in this paragraph wherein the hydrocracked diesel stream is taken as a side cut from a fractionation column. An embodiment of the invention is one, any or all of prior embodiments in this paragraph up through the first embodiment in this paragraph further comprising co-feeding a diesel stream to the hydrotreating step. An embodiment of the invention is one, any or all of prior embodiments in this paragraph up through the first embodiment in this paragraph further comprising producing a naphtha stream and a hydrocracked gas oil stream in the fractionation step. An embodiment of the invention is one, any or all of prior embodiments in this paragraph up through the first embodiment in this paragraph further comprising flashing the liquid hydrocracked stream to provide a flash vaporous hydrocracked stream and a flash liquid hydrocracked stream; stripping the flash liquid hydrocracked stream to provide a stripped hydrocracked stream; fractionating the stripped hydrocracked stream to provide a hydrocracked diesel stream; hydrotreating the hydrocracked diesel stream; and flashing the flash vaporous hydrocracked stream with the separated liquid hydrotreated stream. An embodiment of the invention is one, any or all of prior embodiments in this paragraph up through the first embodiment in this paragraph wherein all of the hydrogen provided to the hydrotreating step is provided in the vaporous hydrocracked stream. An embodiment of the invention is one, any or all of prior embodiments in this paragraph up through the first embodiment in this paragraph wherein the hydrotreating step is operated with the hydrogen and the hydrocarbon in the vaporous hydrocracked stream flowing downwardly in a hydrotreating reactor.

A second embodiment of the invention is a process for producing diesel from a hydrocarbon stream comprising hydrocracking a hydrocarbon feed stream over hydrocracking catalyst in the presence of hydrogen to provide a hydrocracked effluent stream; separating the hydrocracked effluent stream into a vaporous hydrocracked stream and a liquid hydrocracked stream; hydrotreating the vaporous hydrocracked stream over hydrotreating catalyst in the presence of hydrogen, all provided in the vaporous hydrocracked stream, to provide a hydrotreated effluent stream; separating the hydrotreated effluent stream into a vaporous hydrotreated stream and a liquid hydrotreated stream; and stripping the liquid hydrotreated stream to provide a product stream comprising ultra low sulfur diesel. An embodiment of the invention is one, any or all of prior embodiments in this paragraph up through the second embodiment in this paragraph wherein separating the hydrotreated effluent stream comprises separating the hydrotreated effluent stream into a separated vaporous hydrotreated stream and a separated liquid hydrotreated stream and flashing the separated liquid hydrotreated stream to provide a flash vaporous hydrotreated stream and a flash liquid hydrotreated stream comprising the liquid hydrotreated stream. An embodiment of the invention is one, any or all of prior embodiments in this paragraph up through the second embodiment in this paragraph further comprising flashing the liquid hydrocracked stream to provide a flash vaporous hydrocracked stream and a flash liquid hydrocracked stream; stripping the flash liquid hydrocracked stream to provide a stripped hydrocracked stream; fractionating the stripped hydrocracked stream to provide a hydrocracked diesel stream; and hydrotreating the hydrocracked diesel stream. An embodiment of the invention is one, any or all of prior embodiments in this paragraph up through the second embodiment in this paragraph wherein the hydrocracked diesel stream is hydrotreated with the vaporous hydrocracked stream in the hydrotreating step. An embodiment of the invention is one, any or all of prior embodiments in this paragraph up through the second embodiment in this paragraph wherein the hydrocracked diesel stream is taken as a side cut from a fractionation column. An embodiment of the invention is one, any or all of prior embodiments in this paragraph up through the second embodiment in this paragraph further comprising co-feeding a diesel stream to the hydrotreating step. An embodiment of the invention is one, any or all of prior embodiments in this paragraph up through the second embodiment in this paragraph further comprising flashing the flash vaporous hydrocracked stream with the separated liquid hydrotreated stream.

A third embodiment of the invention is a process for producing diesel from a hydrocarbon stream comprising hydrocracking a hydrocarbon feed stream over hydrocracking catalyst in the presence of hydrogen to provide a hydrocracked effluent stream; separating the hydrocracked effluent stream into a vaporous hydrocracked stream and a liquid hydrocracked stream; hydrotreating the vaporous hydrocracked stream over hydrotreating catalyst in the presence of hydrogen to provide a hydrotreated effluent stream; separating the hydrotreated effluent stream into a vaporous hydrotreated stream and a liquid hydrotreated stream; stripping the liquid hydrotreated stream to provide a product stream comprising ultra low sulfur diesel; flashing the liquid hydrocracked stream to provide a flash vaporous hydrocracked stream and a flash liquid hydrocracked stream; stripping the flash liquid hydrocracked stream to provide a stripped hydrocracked stream; fractionating the stripped hydrocracked stream to provide a hydrocracked diesel stream; and hydrotreating the hydrocracked diesel stream. An embodiment of the invention is one, any or all of prior embodiments in this paragraph up through the third embodiment in this paragraph wherein the hydrocracked diesel stream is hydrotreated with the vaporous hydrocracked stream in the first hydrotreating step. An embodiment of the invention is one, any or all of prior embodiments in this paragraph up through the third embodiment in this paragraph wherein all of the hydrogen provided to the hydrotreating step is provided in the vaporous hydrocracked stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for producing diesel from a hydrocarbon stream comprising:

hydrocracking a hydrocarbon feed stream over hydrocracking catalyst in the presence of hydrogen to provide a hydrocracked effluent stream;

separating said hydrocracked effluent stream into a hydrocarbonaceous vaporous hydrocracked stream and a liquid hydrocracked stream;

hydrotreating said hydrocarbonaceous vaporous hydrocracked stream over hydrotreating catalyst in the presence of hydrogen, all provided in the vaporous hydrocracked stream, to provide a hydrotreated effluent stream;

separating said hydrotreated effluent stream into a vaporous hydrotreated stream and a liquid hydrotreated stream; and stripping said liquid hydrotreated stream to provide a product stream comprising ultra low sulfur diesel.

2. The process of claim 1 wherein separating said hydrotreated effluent stream comprises separating said hydrotreated effluent stream into a separated vaporous hydrotreated stream and a separated liquid hydrotreated stream and flashing said separated liquid hydrotreated stream to provide a flash vaporous hydrotreated stream and a flash liquid hydrotreated stream comprising said liquid hydrotreated stream.

3. The process of claim 1 further comprising:

flashing said liquid hydrocracked stream to provide a flash vaporous hydrocracked stream and a flash liquid hydrocracked stream;

stripping said flash liquid hydrocracked stream to provide a stripped hydrocracked stream;

fractionating said stripped hydrocracked stream to provide a hydrocracked diesel stream; and hydrotreating said hydrocracked diesel stream.

4. The process of claim 3 wherein said hydrocracked diesel stream is hydrotreated with said vaporous hydrocracked stream in the hydrotreating step.

5. The process of claim 3 wherein said hydrocracked diesel stream is taken as a side cut from a fractionation column.

6. The process of claim 3 further comprising co-feeding a diesel stream to the hydrotreating step.

7. The process of claim 3 further comprising producing a naphtha stream and a hydrocracked gas oil stream in said fractionation step.

8. The process of claim 2 further comprising:

flashing said liquid hydrocracked stream to provide a flash vaporous hydrocracked stream and a flash liquid hydrocracked stream;

stripping said flash liquid hydrocracked stream to provide a stripped hydrocracked stream;

fractionating said stripped hydrocracked stream to provide a hydrocracked diesel stream;

hydrotreating said hydrocracked diesel stream; and flashing said flash vaporous hydrocracked stream with said separated liquid hydrotreated stream.

9. The process of claim 1 wherein said hydrotreating step is operated with the hydrogen and the hydrocarbon in the vaporous hydrocracked stream flowing downwardly in a hydrotreating reactor.

10. A process for producing diesel from a hydrocarbon stream comprising:

hydrocracking a hydrocarbon feed stream over hydrocracking catalyst in the presence of hydrogen to provide a hydrocracked effluent stream;

separating said hydrocracked effluent stream into a vaporous hydrocracked stream and a liquid hydrocracked stream;

hydrotreating said vaporous hydrocracked stream over hydrotreating catalyst in the presence of hydrogen, all provided in the vaporous hydrocracked stream, to provide a hydrotreated effluent stream;

separating said hydrotreated effluent stream into a vaporous hydrotreated stream and a liquid hydrotreated stream; and stripping said liquid hydrotreated stream to provide a product stream comprising ultra low sulfur diesel.

11. The process of claim 10 wherein separating said hydrotreated effluent stream comprises separating said hydrotreated effluent stream into a separated vaporous hydrotreated stream and a separated liquid hydrotreated stream and flashing said separated liquid hydrotreated stream to provide a flash vaporous hydrotreated stream and a flash liquid hydrotreated stream comprising said liquid hydrotreated stream.

12. The process of claim 11 further comprising:

flashing said liquid hydrocracked stream to provide a flash vaporous hydrocracked stream and a flash liquid hydrocracked stream;

stripping said flash liquid hydrocracked stream to provide a stripped hydrocracked stream;

fractionating said stripped hydrocracked stream to provide a hydrocracked diesel stream; and hydrotreating said hydrocracked diesel stream.

13. The process of claim 12 wherein said hydrocracked diesel stream is hydrotreated with said vaporous hydrocracked stream in the hydrotreating step.

14. The process of claim 12 wherein said hydrocracked diesel stream is taken as a side cut from a fractionation column.

15. The process of claim 12 further comprising co-feeding a diesel stream to the hydrotreating step.

16. The process of claim 12 further comprising flashing said flash vaporous hydrocracked stream with said separated liquid hydrotreated stream.

17. A process for producing diesel from a hydrocarbon stream comprising:

hydrocracking a hydrocarbon feed stream over hydrocracking catalyst in the presence of hydrogen to provide a hydrocracked effluent stream;

separating said hydrocracked effluent stream into a vaporous hydrocracked stream and a liquid hydrocracked stream;

hydrotreating said vaporous hydrocracked stream over hydrotreating catalyst in the presence of hydrogen, all provided in the vaporous hydrocracked stream, to provide a hydrotreated effluent stream;

separating said hydrotreated effluent stream into a vaporous hydrotreated stream and a liquid hydrotreated stream;

stripping said liquid hydrotreated stream to provide a product stream comprising ultra low sulfur diesel;

flashing said liquid hydrocracked stream to provide a flash vaporous hydrocracked stream and a flash liquid hydrocracked stream;

stripping said flash liquid hydrocracked stream to provide a stripped hydrocracked stream;

fractionating said stripped hydrocracked stream to provide a hydrocracked diesel stream; and hydrotreating said hydrocracked diesel stream.

18. The process of claim 17 wherein said hydrocracked diesel stream is hydrotreated with said vaporous hydrocracked stream in the first hydrotreating step.

* * * * *